US005967512A

United States Patent [19]

Irsik

[11] Patent Number: 5,967,512

[45] Date of Patent: Oct. 19, 1999

[54] ASSEMBLY FOR ADJUSTING NIP ROLL SPACING

[76] Inventor: Allen D. Irsik, 9303 Kendall St, Westminster, Colo. 80030

[21] Appl. No.: 09/012,262

[22] Filed: Jan. 23, 1998

Related U.S. Application Data

[60] Provisional application No. 60/037,752, Jan. 24, 1997.

[51] Int. Cl.[6] ..... B65H 5/02

[52] U.S. Cl. ..... 271/273; 226/177

[58] Field of Search ..... 271/272–274, 271/124, 125; 226/176, 177

[56] References Cited

U.S. PATENT DOCUMENTS

| | | | |
|---|---|---|---|
| 2,192,414 | 3/1940 | Reed | 271/274 |
| 2,757,927 | 8/1956 | Bach et al. | 271/274 X |
| 2,873,968 | 2/1959 | Grobman | 271/274 |
| 3,738,557 | 6/1973 | Weck | 226/177 |
| 4,842,007 | 6/1989 | Kurtz . | |
| 5,265,868 | 11/1993 | Bowser et al. | 271/272 X |

*Primary Examiner*—Boris Milef
*Attorney, Agent, or Firm*—Holland & Hart LLP

[57] ABSTRACT

A nip roller assembly for adjusting the vertical movement of a top nip roller with respect to a bottom nip roller mounted on a machine base, the assembly including a frame attached to the base, the frame including opposing upwardly extending guide legs and a datum member attached to each guide leg and extending therebetween. A support assembly is adjustably mounted on the frame. The support assembly includes a hanger member extending between the guide legs and moveably engaged with each guide leg, a pilot member attached to the hanger member and selectively adjustably attached to the datum member, a cylinder attached to the hanger member, the cylinder having a plunger which is selectively expandable and retractable from the cylinder, and a nip roller bracket for rotatably supporting the nip roller, the bracket being attached to the plunger and extending between the upright guide rods. The bracket movably engages each guide rod to allow movement of the nip roller bracket in conjunction with the rod.

29 Claims, 6 Drawing Sheets

ASSEMBLY FOR ADJUSTING NIP ROLL SPACING

This application claims the benefit of U.S. Provisional No. 60/037,752, filed Jan. 24, 1997.

FIELD OF THE INVENTION

This invention relates to improvements in sheet material conveyance, and more particularly to the adjustment of the spacing between nip rollers that move continuous sheet material through processing machines.

BACKGROUND OF THE INVENTION

Sheet material is manufactured into many different products. The sheet material is moved through processing equipment by a series of rollers, typically in pairs, that effectively pull the sheet material. The rollers, called nip rollers, are normally positioned on opposite sides of the material. One roller engages one side and the other roller engages the opposite side. Typically, one roller is driven, and one roller rotates freely. The nip rollers are generally positioned on the downstream end of the machine.

The intermediate spacing between the adjacent rollers is critical since the rollers must sufficiently engage the material to pull it through between the roller, and thus through the processing machine. The intermediate spacing must be consistent along the length of the rollers (between the opposing ends of the adjacent rollers) to consistently engage the sheet material along its width, so the sheet material is pulled evenly through the machine.

Air pressure has been used to hold the nip rollers closed, but this means alone allows the intermediate spacing between the nip rollers to vary along the length of the rollers as the material is pulled through the machine. This causes the sheet material to wander side to side on the nip rollers.

Screw-down mechanical adjustments for adjusting the intermediate spacing have been used. However, this does not allow the sheet material to be loaded on unloaded into the machine quickly or conveniently.

What is needed is a nip roller adjustment assembly to allow the accurate and precise adjustment of the intermediate spacing between the adjacent nip rollers to facilitate the movement of the sheet material through the machine in a straight manner, and at the same time allow the sheet material to be loaded and unloaded quickly, conveniently and safely.

It is with the forgoing problems in mind that the instant invention was developed.

SUMMARY OF THE INVENTION

The present invention concerns sheet material conveyance, and specifically the adjustment of nip rollers used to pull sheet material through processing equipment.

In accordance with the present invention, the inventive nip roller adjustment assembly includes a support assembly suspended on a frame for accurately, precisely and easily adjusting one nip roller with respect to the other nip roller.

In light of the above, therefore, the invention includes a nip roller assembly for adjusting the vertical movement of a top nip roller with respect to a bottom nip roller mounted on a machine base, the assembly including a frame attached to the base, the frame including opposing upwardly extending guide legs and a datum member attached to each guide leg and extending therebetween. A support assembly is adjustably mounted on the frame. The support assembly includes a hanger member extending between the guide legs and moveably engaged with each guide leg, a pilot member attached to the hanger member and selectively adjustably attached to the datum member, a cylinder attached to the hanger member, the cylinder having a plunger which is selectively expandable and retractable from the cylinder, and a nip roller bracket for rotatably supporting the nip roller, the bracket being attached to the plunger and extending between the upright guide rods. The bracket movably engages each guide rod to allow movement of the nip roller bracket in conjunction with the rod. The position of the nip roller bracket along the length of the guide rods is adjusted by the actuation of the pilot member with respect to the datum member.

It is a primary object of the present invention to provide an adjustment assembly which allows precise and accurate adjustment of the intermediate space between adjacent nip rollers.

It is an additional object of the present invention to provide an adjustment assembly which allows consistent adjustment of the intermediate spaces at either end of adjacent nip rollers.

It is an additional object of the present invention to provide an adjustment assembly which allows quick, convenient and safe opening and closing of the nip rollers for loading and unloading the sheet material.

These and other objects, features, and advantages of the invention will become apparent to those skilled in the art from the following detailed description, when read in conjunction with the accompanying drawings and appended claims.

DETAILED DESCRIPTION OF THE PREFERRED EMBODIMENT

Figure 1:
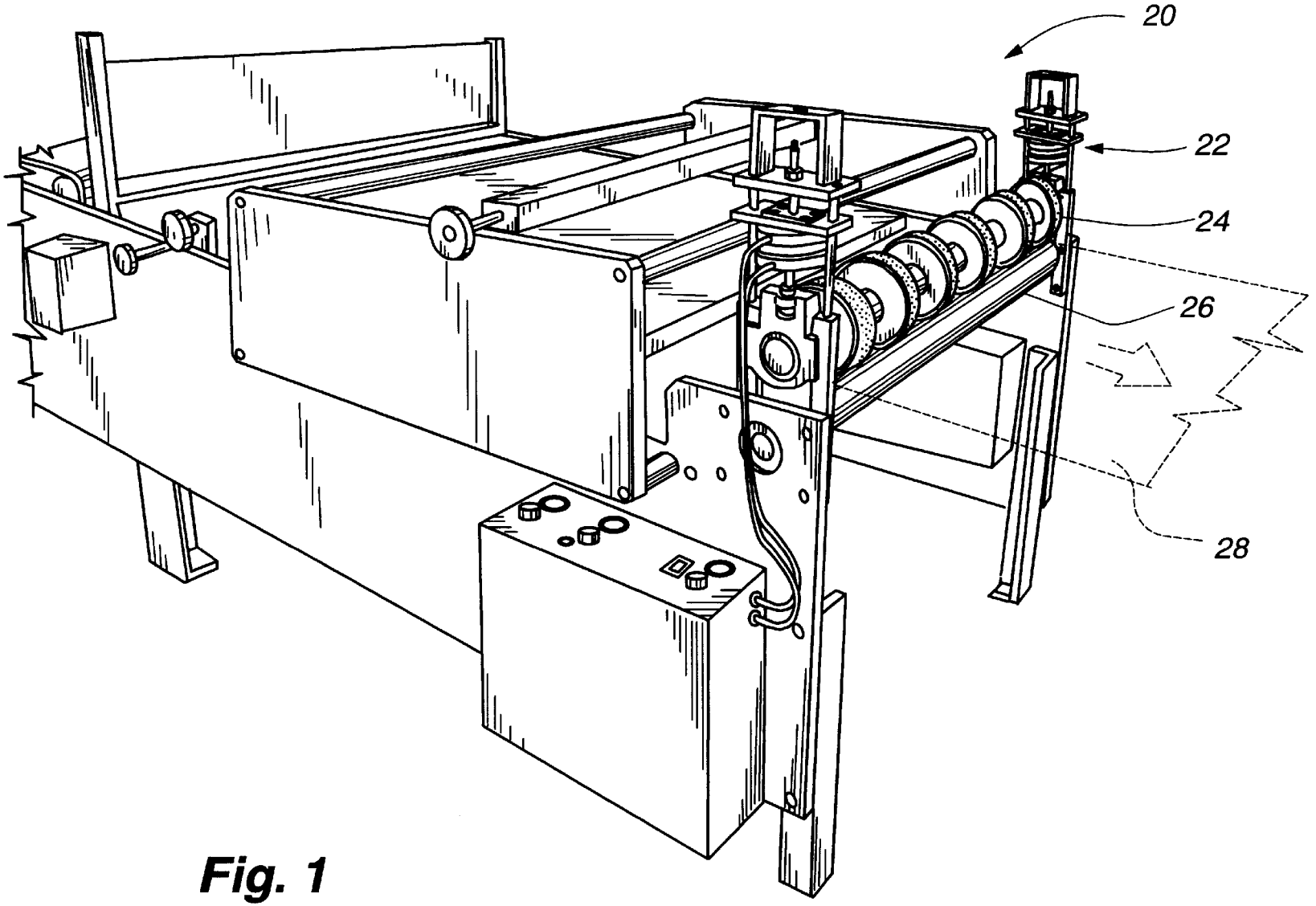
FIG. 1 is a perspective view of a converting machine incorporating the nip roller adjustment assembly of the present invention.
Figure 2:
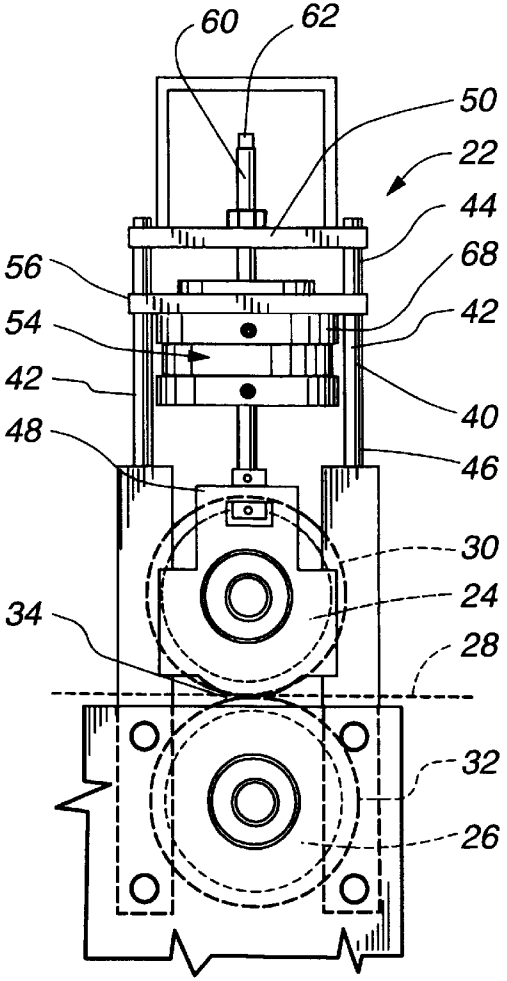
FIG. 2 is a partial side view of the converting machine of FIG. 1 showing the nip roller adjustment assembly.

Referring to FIG. 1, a converting machine 20 incorporating the nip roller adjustment assembly 22 of the present invention is shown. Top 24 and bottom 26 nip rollers are used to pull flexible film sheet material 28, such as low density polyethylene used for constructing bags, through the processing machine 20. As shown in FIG. 2, the bottom nip roller 26 contacts the bottom of the sheet material 28 and the top nip roller 24 contacts the top of the sheet material 28. The sheet material 28 is "pinched" between the bottom 26 and top 24 nip rollers, and when one of the nip rollers is driven (such as by a direct drive motor or a belt-drive motor), the sheet material 28 is pulled through the machine 20. The nip rollers 24, 26 are typically positioned at the down-stream end of the machine 20 to pull the sheet material 28 through the machine.

Figure 9:
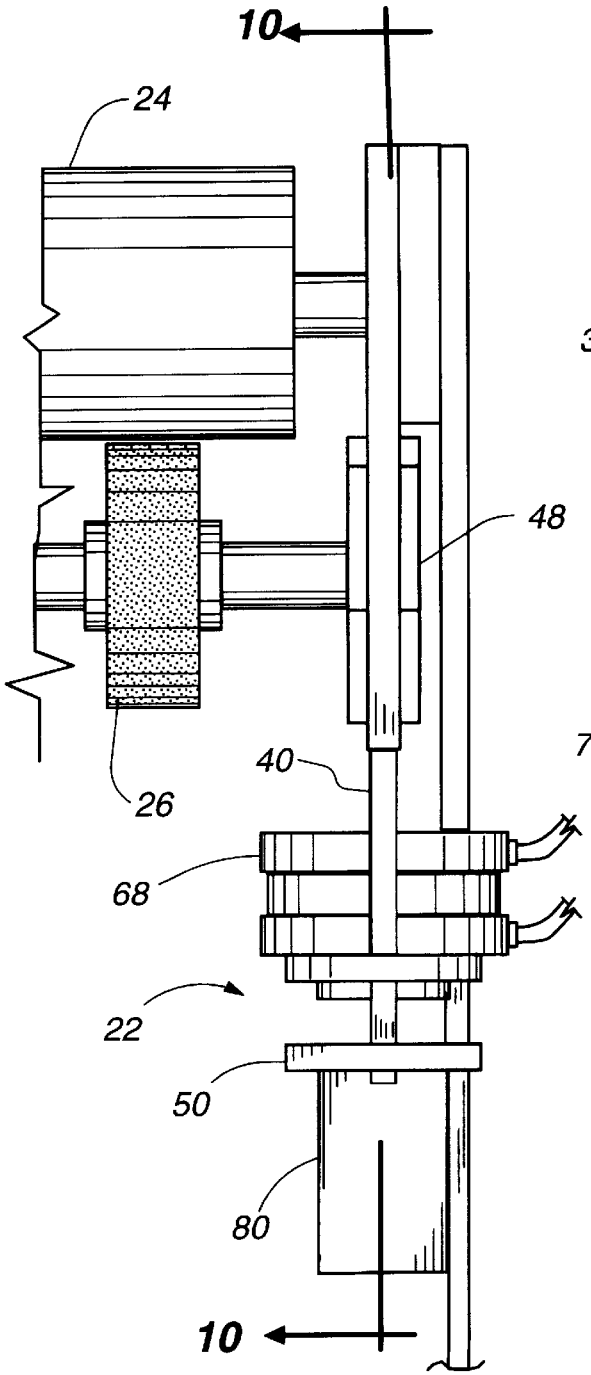
FIG. 9 is a partial end view of an alternate embodiment of the present invention showing an adjustable bottom nip roller assembly.
Figure 10:
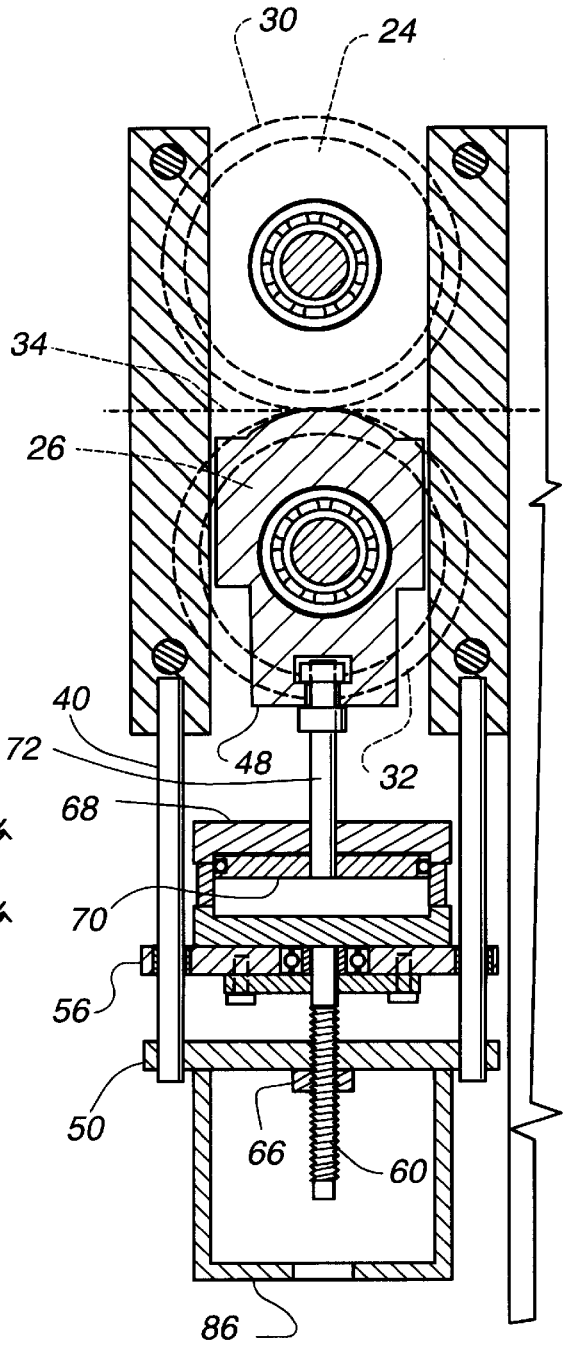
FIG. 10 is a section taken along line 10—10 of FIG. 9.

Typically only the bottom nip roller 26 is driven to pull the sheet material 28 through the processing machine 20, which contains all or part of a manufacturing process, while the top nip roller 24 rotates freely. The top nip roller 24, however, can also be driven, or can be the only nip roller driven with the bottom nip roller 26 rotating freely. In the embodiment described below, the invention is described with the bottom nip roller 26 being driven and the top nip roller 24 rotating freely. It is contemplated that the invention can be applied to the bottom nip roller 26 as shown in FIGS. 9 and 10, or both the top 24 and bottom 26 nip rollers.

Each nip roller 24, 26 has suitable material, such as neoprene rubber, silicone rubber, or urethane, preferably with a 60 Durometer, on its outer engagement surface 30, 32, respectively, in order to accommodate the different materials that it is required to move. Any soft and pliable material similar to the above would work. The nip rollers 24, 26 extend across the width of the machine 20, and are at least as long as the sheet material 28 is wide. The engagement surfaces 30, 32 on each nip roller 24, 26 can be continuous (see bottom nip roller 26 in FIG. 3), or can be formed into sections (see top nip roller 24 in FIG. 3).

The spacing 34 between the nip rollers 24, 26 is important to insure proper engagement with the sheet material 28. The intermediate spacing 34 is between the engagement surface 30 of the top nip roller 24 and the engagement surface 32 of the bottom nip roller 26. The engagement surface is that portion of the nip roller in contact with sheet material 28. Where the nip roller is continuous (such as 26), the engagement surface 32 is effectively the outer circumferential surface (radial surface) of a cylindrical body. Where the nip roller is formed into spaced sections (such as 24), the engagement surface 30 is effectively the outer circumferential surface (radial surface) of a sectioned cylindrical body.

The intermediate spacing 34 can be subject to relatively frequent adjustment to accommodate maintenance, different thickness sheet materials, material tracking, and to control wrinkles in the sheet material. This requires the nip rollers 24, 26 to be moved away from and toward one another precisely and accurately at all points along the length of both top 24 and bottom 26 nip rollers that engage the sheet material. The nip roller adjustment assembly 22 of the present invention allows the precise fine-adjustment of the intermediate spacing 34 at either or both ends of the nip rollers 24, 26 by a threaded mechanism, and the gross adjustment of the intermediate spacing 34 by use of a pneumatic cylinder. The gross adjustment could be made by a hydraulic cylinder or other means, such as an electric motor. In the presently described embodiment, the invention is described using a pneumatic cylinder.

Figure 5:
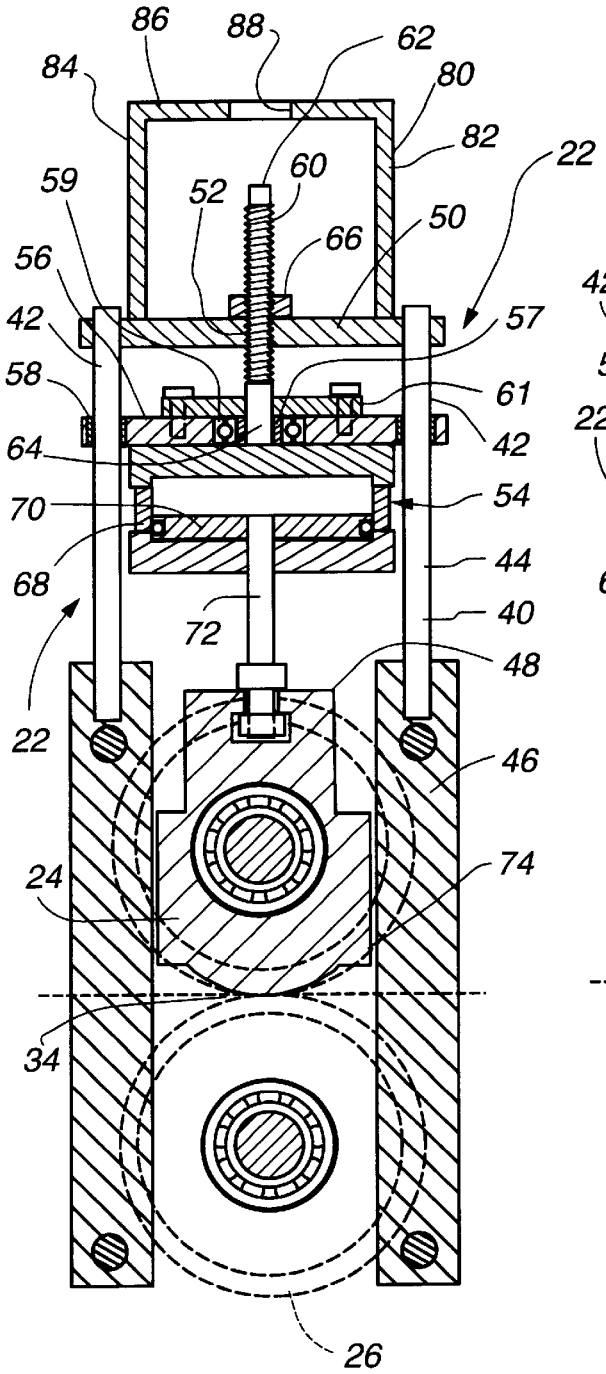
FIG. 5 is a section taken along line 5—5 of FIG. 3.

The bottom nip roller 26 is rotatably held by its opposing ends in a fixed position by a base portion 36 of the processing machine. The rotation of the bottom nip roller 26 is driven and controlled by a motor assembly 38, as is known or available in the industry. The top nip roller 24 is rotatably supported at its opposing ends and is selectively moveable between an upper, or release, position (FIG. 6) and a lower, or engaged, position (FIG. 5). In the release position, the top nip roller 24 is moved away from the bottom nip roller 26 to allow the positioning of material 28 between the nip rollers, for maintenance and cleaning, or other such reasons. In the release position the engagement surface 30 of the top nip roller 24 is spaced approximately ¾ inches to 1 inch away from the engagement surface 32 of the bottom nip roller 26. This distance can be modified as desired by the user.

Typically, in the engaged position the engagement surface 30 of the top nip roller 24 is spaced approximately 0.00 inches to approximately 0.010 inches away from the engagement surface 32 of the bottom nip roller 26. This range of spaced distance can be modified as desired by the user. It is extremely important to be able to adjust the spacing 34 between the nip rollers 24, 26 when they are in the engaged position. This helps insure the proper engagement of the nip rollers, top 24 and bottom 26, with the sheet material 28 passing therebetween, which greatly affects the processing efficiencies (such as avoiding the uneven pull of material through processing equipment, etc.).

The assembly 22 for adjusting nip roll pressures of the present invention provides structure that allows for the adjustment of the space 34 between the nip rollers when in the engaged (FIG. 5) or the release (FIG. 6) position. It should be understood that the following structure can be used on either the top 24, bottom 26 or both nip rollers. In the following description, for simplicity, the assembly for adjusting nip roll pressure is described for a top nip roller that rotates freely.

Figure 3:
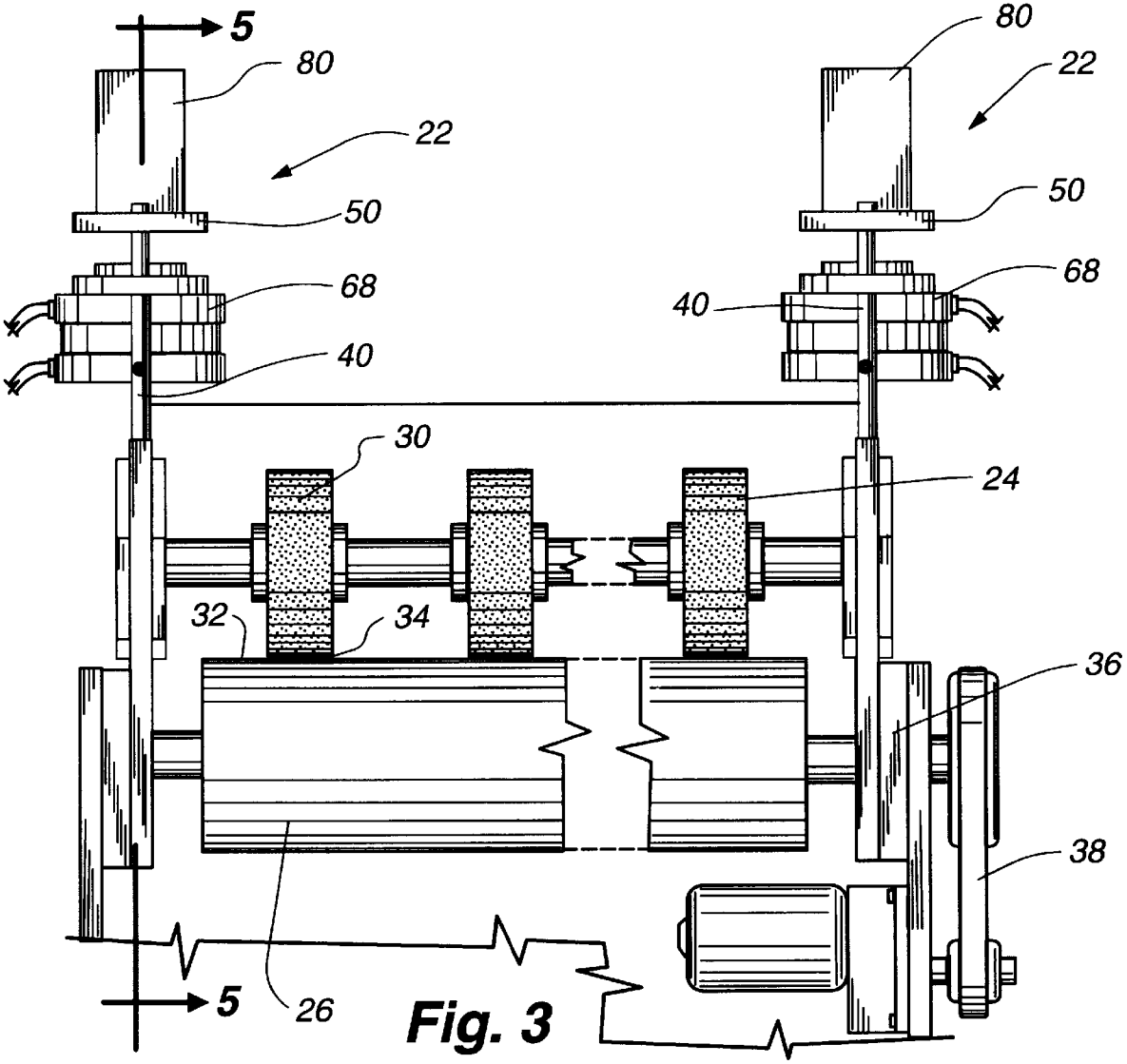
FIG. 3 is an enlarged end view of the converting machine of FIG. 1 showing the nip roller adjustment assembly in the engaged position.
Figure 4:
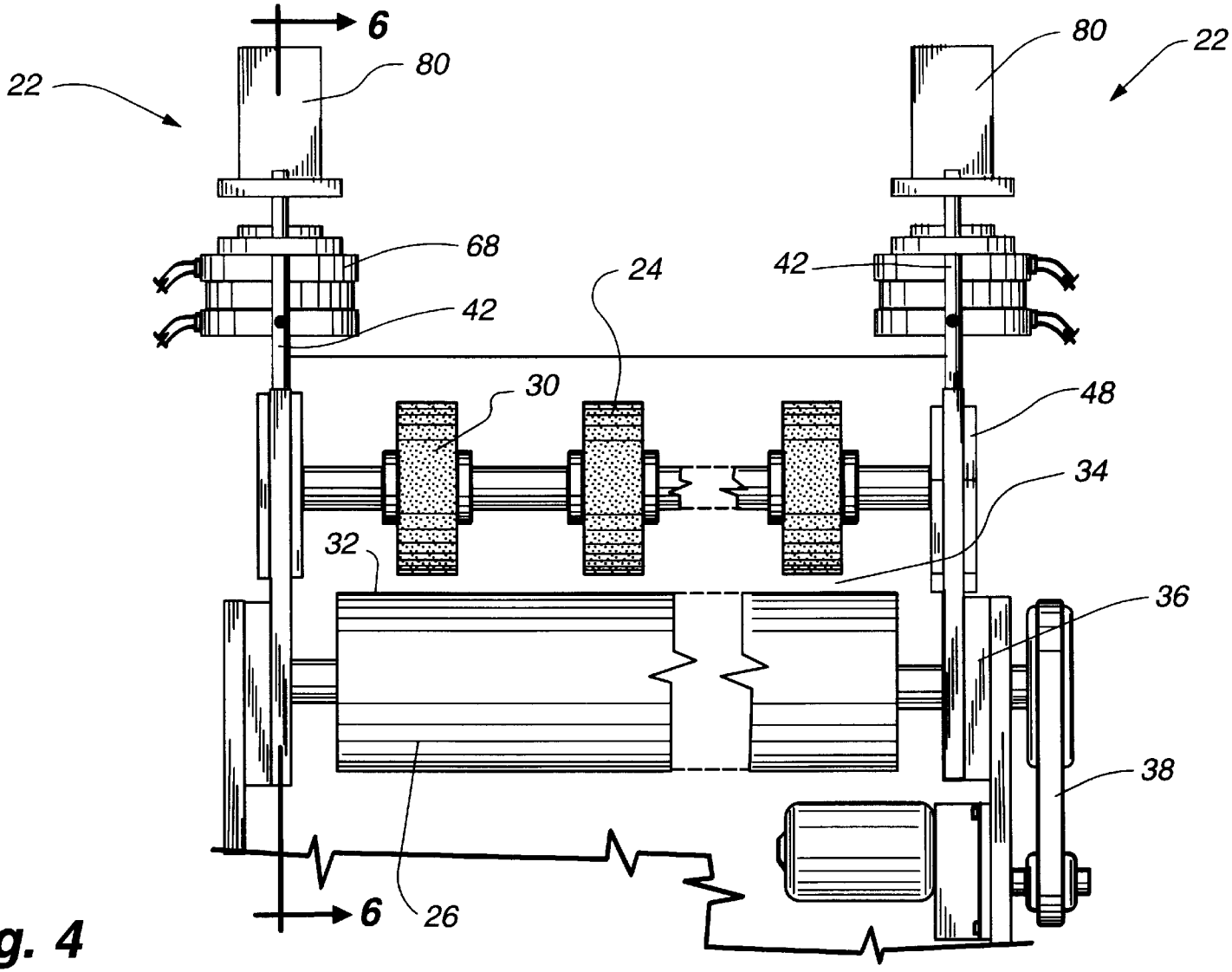
FIG. 4 is an enlarged end view of the converting machine of FIG. 1 showing the nip roller adjustment assembly in the release position.

The assembly 22 is mounted at each end of the top nip roller 24, as shown in FIGS. 3 and 4. A frame member 40 is attached to the base 36 and includes two upright guide members 42. Each upright guide member 42 has a top section 44 and a bottom section 46. The top section 44 is preferably cylindrical in shape to receive a sleeve bearing, as discussed in more detail below. The bottom section 46 is preferably rectangular or square in cross section to act as a guide to the bracket 48, as discussed in more detail below. A datum cross member 50 is affixed across the top ends 44 of the upright side members 42. The datum cross member 50 defines a threaded aperture 52 formed therethrough at a generally central location.

The base member 36 also rotatably supports the lower nip roller 26 in this embodiment. In any event, the frame member 40 supports the top nip roller 24 in a selective moveable orientation to the lower nip roller 26. The frame 40 is preferably made of metal or other suitable material.

A support assembly 54 is adjustably suspended from the datum cross member 50 of the frame 40. The support assembly 54 includes a hanger member 56 that slidably engages the top sections 44 of the frame member 40. The hanger member 56 defines apertures 58 in each end for slidable engagement with the opposing guide members 42. Preferably, a sleeve bearing is positioned in each aperture 58 to facilitate sliding engagement with the top portions 44 of guide members 40.

Figure 6:
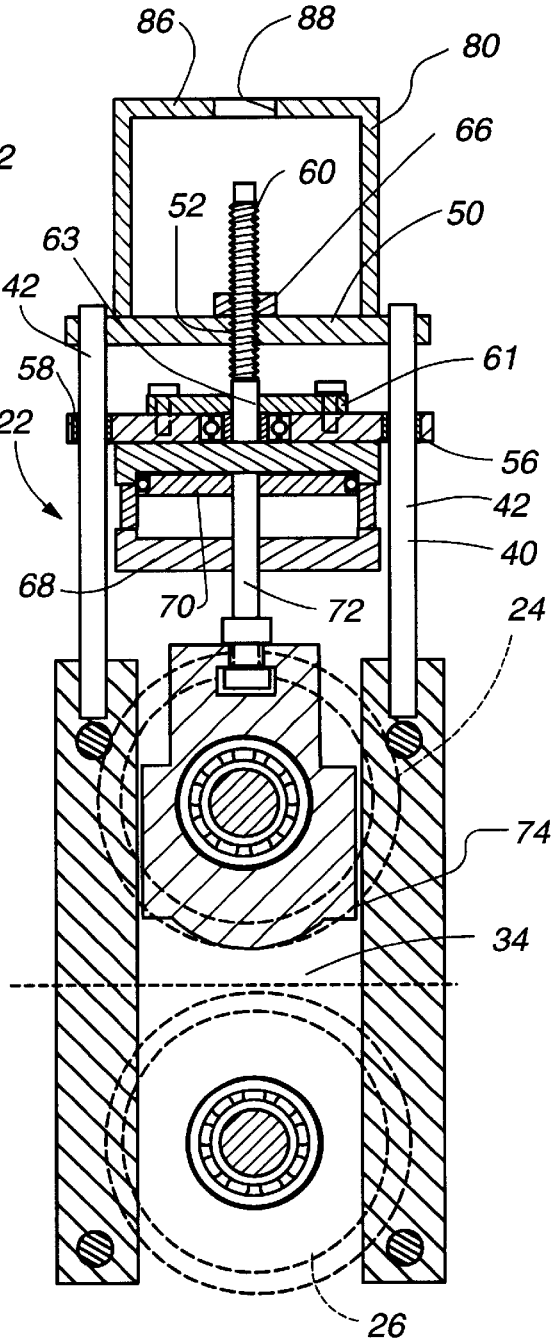
FIG. 6 is a section taken along line 6—6 of FIG. 4.

The hanger member 56 is held in adjustable position with respect to the datum cross member 50 by an externally threaded pilot bolt 60 defining a keyed top end 62. The pilot bolt 60 is threadedly engaged in the aperture 52 formed through the datum cross member 50 to move up and down with respect to the datum cross member as it is turned using the keyed top end 62. The bottom end 64 of the pilot bolt 60 is rotatably affixed to the hanger member 56, as shown in FIGS. 5 and 6. A bushing 57 is mounted on the bottom end of the pilot bolt 60, and is received in a bearing 59 press-fit into an aperture formed in the hanger member 56. The bushing (and pilot bolt) thus turns independently with respect to the hanger member 56. A retaining plate 61 is attached to the top of the hanger member 56 to secure the bushing 57 in the bearing 59 to keep the pilot bolt 60 from disconnecting from the hanger member 56. An aperture 63 is formed through the retaining plate 61 to rotatably receive the pilot bolt 60.

The hanger member 56 is moved upwardly and downwardly with the pilot bolt 60. A lock nut 66 is threaded onto the pilot bolt 60 on the top of the datum cross member 50 to cinch (or jam) the position of the pilot bolt 60 in the datum cross member 50 so it does not rotate unintentionally and inadvertently move upwardly or downwardly.

The attachment of the pilot bolt to the hanger member is shown in FIGS. 5 and 6.

A pancake air cylinder 68, such as model FO-500.75, available from the Bimba Company, is suspended from the hanger member 56. The air cylinder 68 has a plunger 70 that is selectively actuated by air pressure to extend a push rod 72 downwardly a given fixed distance from the cylinder 68 in the engage position (FIGS. 3 and 5), and to retract the plunger 70 in the release position (FIGS. 4 and 6), as set forth above. The operation and control of the cylinder 68 is by known or available means, and does not form a part of the instant invention.

A bracket member 48 is attached to the bottom of the push rod 72. The bracket member 48 rotatably supports the end of the top nip roller 24, and moves with the selective movement of the push rod 72 of the cylinder 68 from the engaged position to the release position. Each of the opposite ends of the bracket 48 form a channel 74 to receive the lower sections 46 of the uprights 40 in a bearing relationship to provide alignment and stability as the bracket 48 is moved by the cylinder 68 or the pilot bolt 60.

The fine adjustment of the gap 34 between the top 24 and bottom 26 nip rollers is effected by the actuation or adjustment of the pilot bolt 60 with respect to the datum cross member 50. The air cylinder 68 moves the top nip roller 24 from the engaged to the released position and back as desired for gross adjustment of the relative positioning of the rollers 24, 26. Use of the pilot bolt 60 provides the fine adjust of the position of the top nip roller 24, whether in the release or engaged position. When the pilot bolt 60 is turned to move the pilot bolt downwardly (with respect to FIGS. 5 and 6) in the datum member 50, the bracket 48 is moved downwardly the same distance as the pilot bolt 60 is displaced. When the pilot bolt 60 is turned to move the pilot bolt 60 upwardly (with respect to FIGS. 5 and 6) in the datum member 50, the bracket 48 is moved upwardly the same distance as the pilot bolt 60 is displaced.

The pilot bolt 60 can be adjusted in the datum member 50 manually or automatically by a computer controlled motor drive, as is known or available in the art. If adjusted manually, a wrench 78 is required to receive the keyed top end 62 of the pilot bolt 60. While the keyed end 62 of the pilot bolt 60 could simply be a hexagonal shape, a more unique keyed shape is more effective in minimizing accidental or otherwise undesired adjustment of the pilot bolt 60.

A guard 80 is mounted on top of the frame 40 to assist in deterring improper or unwanted adjustment of the intermediate gap 34 between the top 24 and bottom 26 nip rollers. The guard 80 includes two upright braces 82, 84 extending upwardly from the datum member 50. A top member 86 extends between the upright members 82, 84 and defines an aperture 88 directly above the top of the pilot bolt 60. The wrench 78 shaped to fit the keyed top end 62 of the pilot bolt 60 is positioned through the aperture 88 to engage the pilot bolt 60 and allow it to be turned to make the desired adjustments to the intermediate gap 34, as described above.

Figure 7:
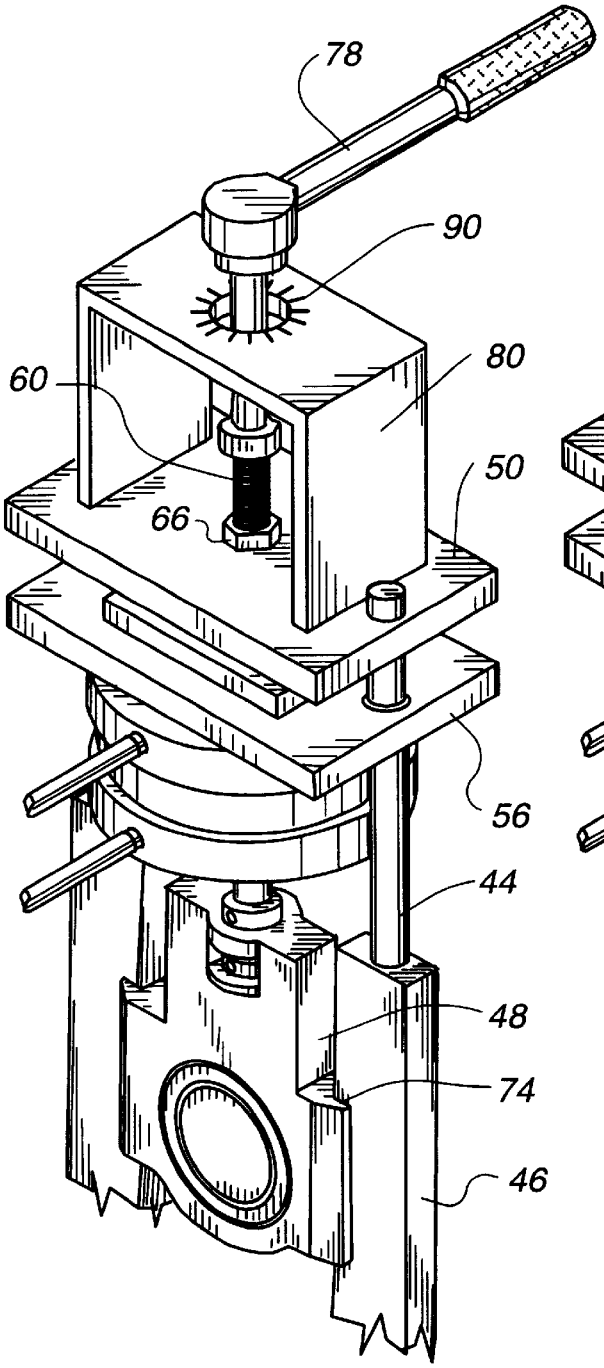
FIG. 7 is an enlarged perspective view of the calibration system of the present invention.

A calibration system, such as in FIG. 7, is used to measure the amount the pilot bolt 60 has been turned, which facilitates accurate and precise adjustment of the intermediate gap 34. It also helps insure that both ends of the top nip roller 24 are identically positioned so that the intermediate gap 34 is consistent along the length of the nip rollers. One type of calibration system is the use of degree markings around the aperture of the datum member, with an indicator formed on the pilot bolt. Degree markings 90 can also be used on the top member 86 of the guard 80, with the handle of the adjustment wrench 78 used as a mark (FIG. 7).

Figure 8:
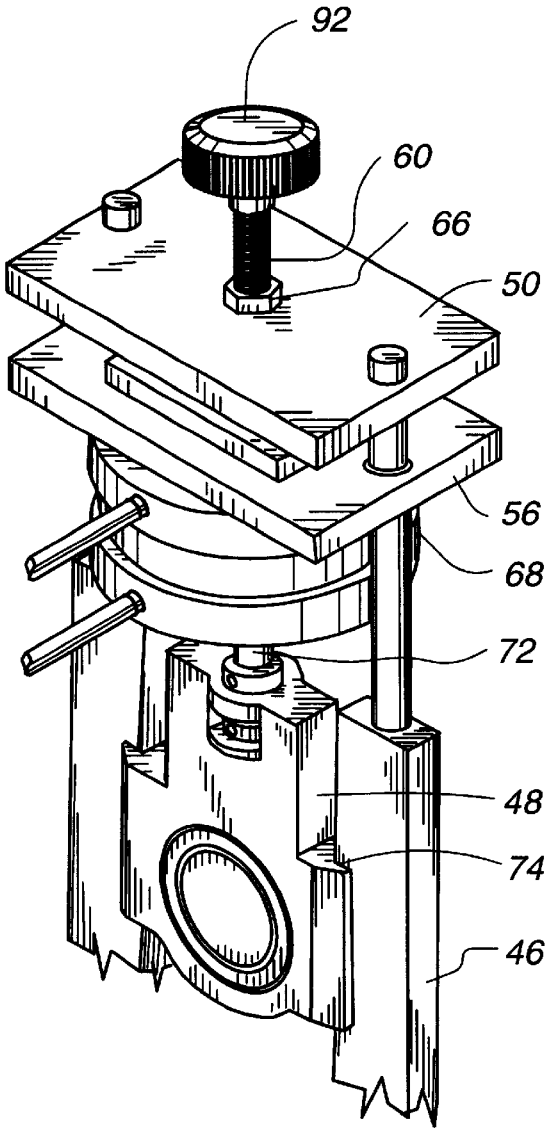
FIG. 8 is an enlarged perspective view of the present invention and shows a knob adjuster.

FIG. 8 shows an alternative embodiment of the adjustment assembly. No guard is utilized, only a knob 92 on the top of the pilot bolt 60 is used.

In operation, a user unlocks the lock nut 66 by threading it away from the datum cross member 50 to disengage it therefrom and release the cinching force between the pilot bolt 60 and the datum cross member 50. The user then inserts the adjustment wrench 78 through the aperture 88 in the top member of the guard 80. The wrench 78 engages the keyed top end 62 of the pilot bolt 60 and is used to turn the pilot bolt 60 accordingly to raise or lower the pilot bolt 60 with respect to the datum cross member 50. The movement in the pilot bolt 60 creates resulting corresponding movement of the bracket member 48 through the movement of the support assembly 54, and thereby moves the top nip roller 24. The adjustment of the gap 34 can be performed with the cylinder 68 in the release or engaged position. Most adjustments will be made with the cylinder in the engaged position to closely position nip roller 24, 26. The adjustment assembly 22 on the opposite end of the top nip roller 24 is then identically adjusted, using the calibration system to help insure that the adjustment on both ends of the top nip roller 24 are the same.

The pilot bolt 60 has fine threading on its exterior surface to match the fine threading in the aperture 52 through the datum cross member 50, which allows for fine adjustment of the intermediate gap 34 between the top 24 and bottom 26 nip rollers. Preferably, the pilot bolt 60 is ½ inch in diameter, and has #20 threads, or is ⅜ inch in diameter and uses #24 threads. This allows fine adjustment of the gap 34 between the top 24 and bottom 26 nip rollers from preferably 0.00 inches to 0.010 inches in accurate increments. For instance, a one degree turn of a #20 thread moves the pilot bolt 60 axially by approximately 0.000138 inches. More coarse or more fine thread can be used as needed for desired total movement and increment accuracy.

The proper adjustment of the gap 34 between the top 24 and bottom 26 nip rollers using the above described structure provides for more consistent engagement (and thus pressure of engagement) with the sheet material 28, and thus better and more consistent processing performance.

While this invention has been described with reference to the illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

I claim:

1. A nip roller assembly for adjusting the vertical movement of a nip roller with respect to a bottom roller mounted on a machine base, said assembly comprising:

a frame attachable to the base, said frame including opposing upwardly extending guide members and a datum member attached to each of said guide members and extending therebetween;

a support assembly adjustably mounted on said frame, said support assembly comprising:

a hanger member extending between said guide members and moveably engaged with each of said guide members;

a pilot member attached to said hanger member and selectively adjustably attached to said datum member;

a cylinder attached to said hanger member, said cylinder having a plunger which is selectively expandable and retractable within the cylinder;

a nip roller bracket, for rotatably supporting said nip roller, attached to the plunger and extending between said upright guide members, said bracket movably engaged to each of said guide members to allow movement of the nip roller bracket in conjunction with the plunger; and wherein the position of said nip roller bracket along the length of said guide members is adjusted by the actuation of said pilot member with respect to said datum member.

2. The nip roller assembly of claim 1, wherein said cylinder is a pneumatic cylinder.

3. The nip roller assembly of claim 1, wherein said pilot member selectively adjusts a vertical intermediate gap distance between an engagement surface of said nip roller and an engagement surface of said bottom roller.

4. The nip roller assembly of claim 1, wherein as said plunger retracts, an engagement surface of said nip roller is vertically spaced a release distance away from an engagement surface of said bottom roller.

5. The nip roller assembly of claim 1, wherein as said plunger expands, an engagement surface of said nip roller is vertically spaced a engaged distance away from an engagement surface of said bottom roller.

6. The nip roller assembly of claim 1, wherein at least one push rod attaches said roller bracket to said plunger.

7. The nip roller assembly of claim 1, wherein said pilot member is a threaded bolt.

8. The nip roller assembly of claim 1, further comprising a locking member engaged to said pilot member and selectively locking said pilot member to said hanger member in a fixed position.

9. The nip roller assembly of claim 8, wherein said locking member is a locking nut.

10. The nip roller assembly of claim 1, further comprising a calibration means for measuring a vertical distance between said datum member and said hanger member.

11. The nip roller assembly of claim 1, further comprising:

a pair of upright guard members, each said upright guard member having a first end and a second end, said first end extending vertically from said datum member; and a top guard member mounted to said second end of said each upright member and said top guard member having an aperture axially aligned with said pilot member.

12. The nip roller assembly of claim 11, further comprising a plurality of degree markings on said top guard member surrounding said aperture.

13. The nip roller assembly of claim 1, further comprising a tool for selectively engaging said pilot member.

14. An apparatus adjusting a vertical space between a top roller and a bottom roller of a nip roller assembly, the apparatus comprising:

a frame having a pair of vertically extending guide members;

a bracket member moveably engaged to said guide members and having a first end and a second end, said first end rotatably supporting said top roller; and a support assembly for adjusting the vertical space between said top roller and said bottom roller, said support assembly adjustably mounted to said guide members, said support assembly connected to said second end of said bracket member, and said support assembly including a fine adjust assembly and a gross adjust assembly.

15. The apparatus of claim 14, wherein said fine adjust assembly adjusts a vertical intermediate gap distance between an engagement surface of said top roller and an engagement surface of said bottom roller.

16. The apparatus of claim 14, wherein said gross adjust assembly selectively adjusts the distance between said top roller and bottom roller between an engaged distance and a retracted distance.

17. The apparatus of claim 14, wherein said gross adjust assembly includes a cylinder having a plunger, said plunger connected to said bracket member, and said plunger is selectively expandable and retractable within said cylinder.

18. The apparatus of claim 14, wherein said fine adjust assembly includes:

a datum member attached to said guide members;

a hanger member extending between said guide members and moveably engaged with said guide members, said hanger member attaching said fine adjust assembly to said gross adjust assembly; and a pilot member attached to said hanger member and selectively adjustably attached to said datum member.

19. The apparatus of claim 18, wherein said pilot member is a threaded bolt.

20. The apparatus of claim 19, further comprising a locking member engaged to said pilot member and selectively locking said pilot member to said hanger member in a fixed position.

21. The apparatus of claim 20, wherein said locking member is a locking nut.

22. An apparatus adjusting a vertical space between a top roller and a bottom roller of a nip roller assembly, the apparatus comprising:

a frame comprising a pair of vertically extending guide members;

a bracket member moveably engaged to said guide members and having a first end and a second end, said first end rotatably supporting said bottom roller; and a support assembly for adjusting the vertical space between said top roller and said bottom roller, said support assembly adjustably mounted to said guide members, said support assembly connected to said second end of said bracket member, and said support assembly including a fine adjust assembly and a gross adjust assembly.

23. The apparatus of claim 22, wherein said gross adjust assembly includes a cylinder having a plunger, said plunger connected to said bracket member, and said plunger is selectively expandable and retractable within said cylinder.

24. The apparatus of claim 22, wherein said fine adjust assembly includes:

a datum member attached to said guide members;

a hanger member extending between said guide members and moveably engaged with said guide members, said hanger member attaching said fine adjust assembly to said gross adjust assembly; and a pilot member attached to said hanger member and selectively adjustably attached to said datum member.

25. An apparatus for adjusting the vertical spacing between a top roller and a bottom roller of a nip roller assembly, the apparatus comprising:

a base;

a pair of guide members, each of said guide members having a first end and a second end, said first end extending vertically from said base;

a datum member attached to said second end of each of said guide members;

a pilot member mounted moveably engaged to said datum member for adjusting a vertical intermediate gap distance between an engagement surface of said top roller and an engagement surface of said bottom roller;

a hanger member moveably engaged to each of said guide members and attached to said datum member;

a cylinder attached to said hanger member, said cylinder having a plunger which is selectively positioned from an engaged position to a released position; and a roller bracket moveably engaged to said guide members, having a first end attached to said plunger, and a second end rotatably attached to said top roller.

26. The apparatus of claim 25, wherein at least one push rod attaches said roller bracket to said plunger.

27. The apparatus of claim 25, further comprising a calibration means for measuring a vertical distance between said datum member and said hanger member.

28. The apparatus of claim 25, further comprising:

a pair of upright guard members, each said upright guard member having a first end and a second end, said first end extending vertically from said datum member; and a top guard member mounted to said second end of said each upright member and said top guard member having an aperture axially aligned with said pilot member.

29. The apparatus of claim 28, further comprising a plurality of degree markings on said top guard member surrounding said aperture.

* * * * *